US005150546A

United States Patent [19]

Tucker

[11] Patent Number: 5,150,546

[45] Date of Patent: Sep. 29, 1992

[54] DISC SANDER IMPLEMENT

[76] Inventor: Clifton E. Tucker, 11000 Tom Weiskopf, El Paso, Tex. 79936

[21] Appl. No.: 801,427

[22] Filed: Dec. 2, 1991

[51] Int. Cl.[5] ..... B24B 23/02

[52] U.S. Cl. ..... 51/170 T; 51/168

[58] Field of Search ..... 51/168, 170 T, 170 R, 51/177, 180

[56] References Cited

U.S. PATENT DOCUMENTS

| | | | |
|---|---|---|---|
| 2,371,021 | 3/1945 | Berry | 51/168 |
| 2,542,154 | 2/1951 | Mesirow | 51/168 |
| 2,767,527 | 10/1956 | Tocci-Guilbert | 51/168 |
| 2,810,239 | 10/1957 | Burleigh | 51/168 |
| 2,918,760 | 12/1959 | Lilleberg | 51/168 |
| 3,053,063 | 9/1962 | Lilleberg | 51/168 |
| 4,369,602 | 1/1983 | Amicei | 51/168 |
| 4,774,788 | 10/1988 | Shacham | 51/168 |

*Primary Examiner*—Roscoe V. Parker
*Attorney, Agent, or Firm*—Richard L. Miller

[57] ABSTRACT

A disc sander implement is provided which consists of a flexible disc shaped connector between a rigid pad and a spindle that may be connected to a driving unit, so that an abrasive sheet material on a cushion member attached to the rigid pad will remain in a flat contact on a work surface and thereby smooth it without swirl with only a slight pressure and little effort when a user of the driving unit moves the sander in a pendulum motion across the work surface.

5 Claims, 2 Drawing Sheets

DISC SANDER IMPLEMENT

BACKGROUND OF THE INVENTION

The instant invention relates generally to motor-driven power sander tools and more specifically it relates to a disc sander implement.

Numerous motor-driven power sander tools have been provided in the prior art that are adapted to rotate hubs having circular sandpaper discs attached thereto. For example, Hutchins U.S. Pat. No. 3,510,992; Wynn U.S. Pat. No. 3,928,946 and Van Buren, Jr. U.S. Pat. No. 4,245,438 all are illustrative of such prior art. While these units may be suitable for the particular purpose to which they address, they would not be as suitable for the purpose of the present invention as hereafter described.

SUMMARY OF THE INVENTION

A primary object of the present invention is to provide a disc sander implement that will overcome the shortcomings of the prior art devices.

Another object is to provide a disc sander implement that incorporates the use of a flexible connector between a rigid pad and a spindle, so that an abrasive sheet of sandpaper will remain in a flat contact on a work surface with a slight pressure and little effort.

An additional object is to provide a disc sander implement that will allow the user to operate the sander in a pendulum motion while maintaining full flat contact of even pressure on a work surface with smooth and constant transfer of power with total contact between the sander's abrasive and the working surface which thereby eliminates swirl marks on the finished piece surface.

A further object is to provide a disc sander implement that is simple and easy to use.

A still further object is to provide a disc sander implement that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
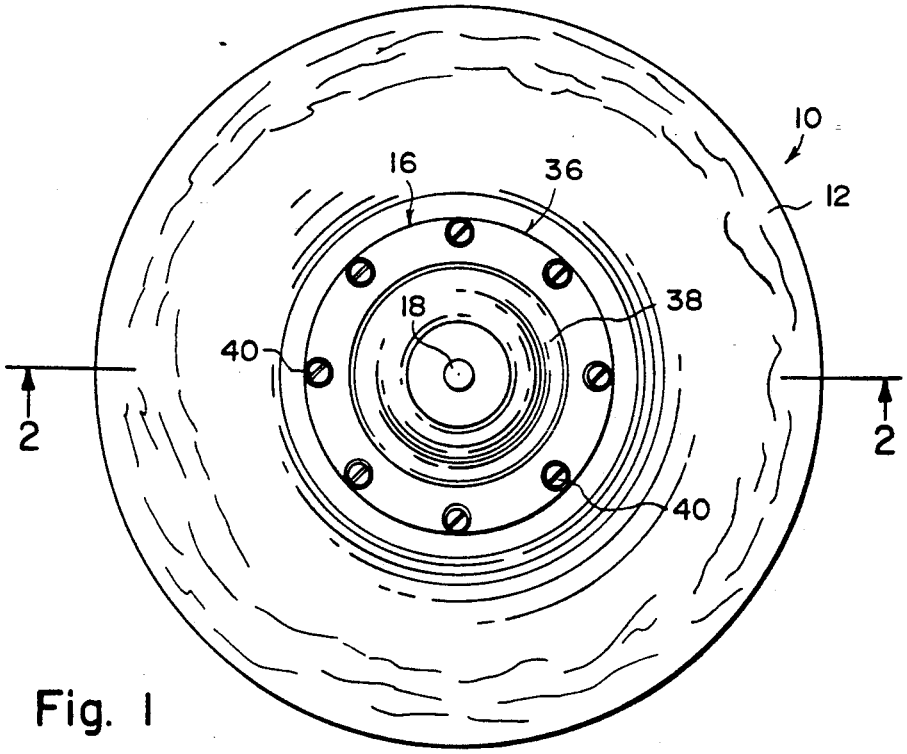
FIG. 1 is a plan view of a first embodiment of the instant invention.

Turning now descriptively to the drawings, in which similar reference characters denote similar elements throughout the several views, the Figures illustrate a disc sander implement 10, which consists of a circular rigid pad 12 fabricated out of a durable material and having a large central aperture 14 therethrough. A disc shaped flexible connector 16 is secured at its periphery to the rigid pad 12 in the large central aperture 14. A spindle 18 having an enlarged head 20 is securely embedded into the flexible connector 16 at essentially a central location for detachably connecting the rigid pad 12 to a driving unit 22 and for rotation relative to a portion of the driving unit 22. The large central aperture 14 in the rigid pad 12 will give clearance for bending and flexing of the flexible connector 16 when rotating. A cushion member 24 of sponge rubber is attached to the rigid pad 12 by a permanent adhesive 26. The cushion member 24 extends over the large central aperture 14 at a forward side thereof. An abrasive sheet of sandpaper, emery cloth, silicon carbide fabric, etcetera 28 is removably affixed to a front side of the cushion member 24 by adhesive 30. The abrasive sheet 28 will always remain in a flat contact with a work surface 32 with a slight pressure and little effort when a user 34 of the driving unit 22 moves the sander 10 in a pendulum motion across the work surface 32.

Figure 2:
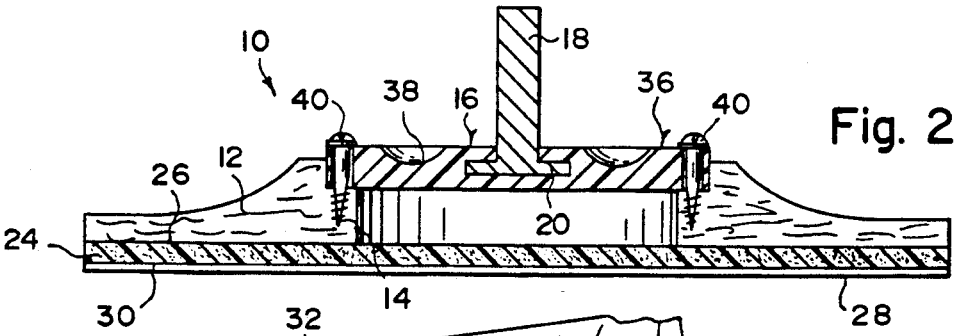
FIG. 2 is an enlarged cross sectional view taken along line 2—2 of FIG. 1.
Figure 4:
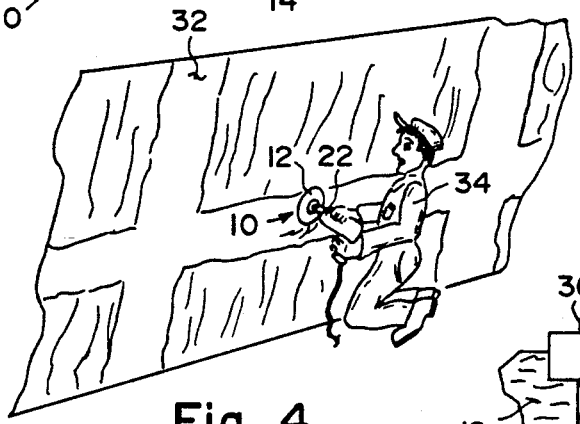
FIG. 4 is a diagrammatic perspective view illustrating the instant invention in use.
Figure 3:
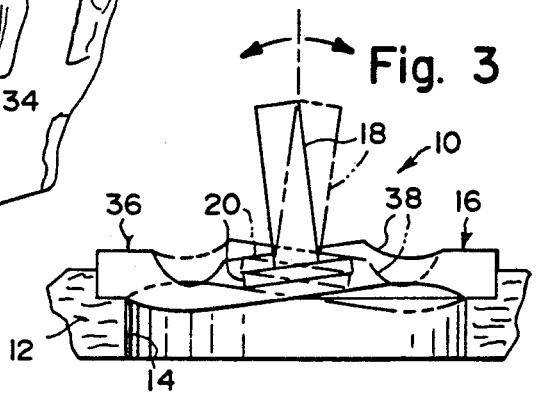
FIG. 3 is a partial diagrammatic sectional view similar to FIG. 2, but with parts broken away illustrating flexure taking place.
Figure 5:
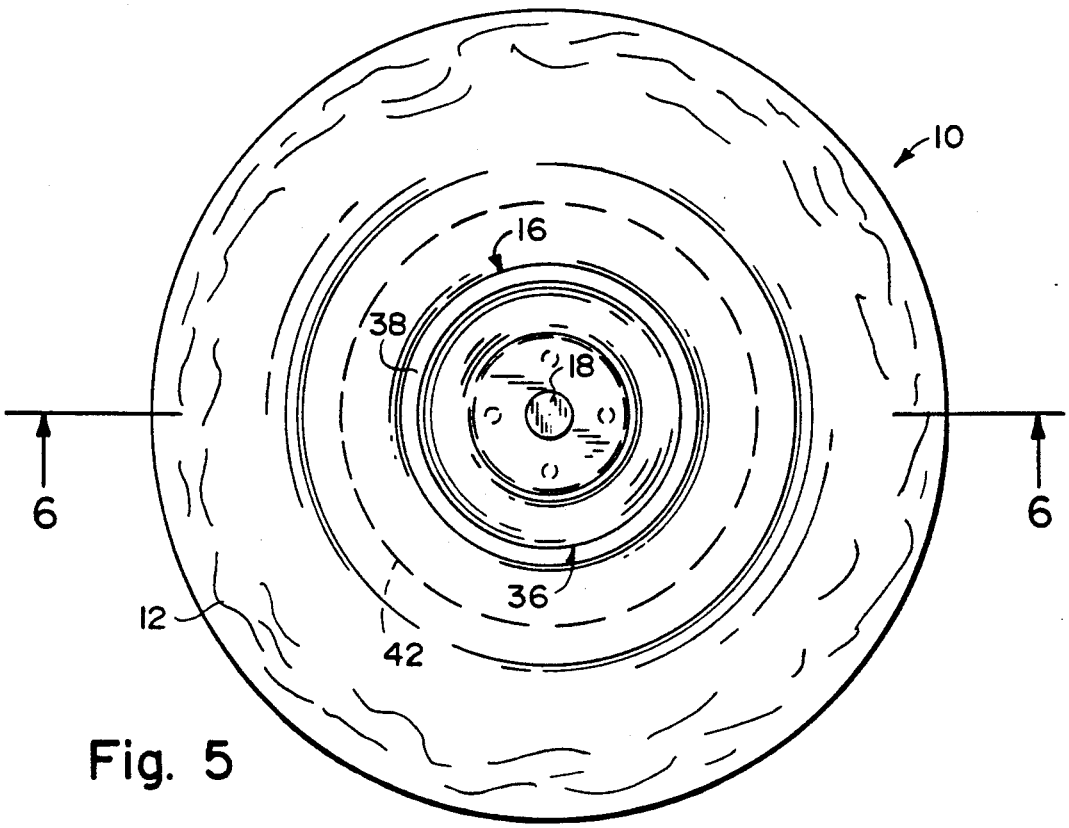
FIG. 5 is a plan view of a second embodiment of the instant invention.
Figure 6:
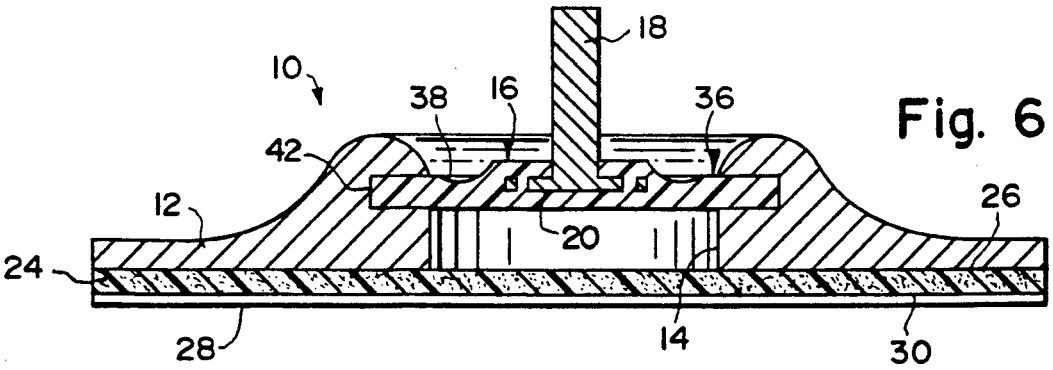
FIG. 6 is a cross sectional view taken on line 6—6 of FIG. 5.
Figure 7:
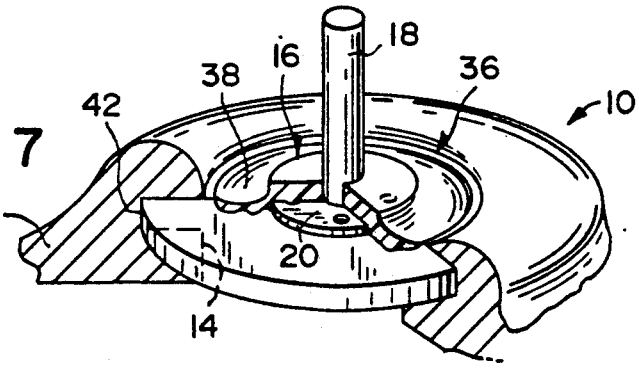
FIG. 7 is a diagrammatic perspective sectional view with parts broken away illustrating in greater detail an internal construction of the second embodiment.

The flexible connector 16 is an elastomer disc shaped member 36 having an annular concave recess 38 in a top surface thereof, to allow the elastomer disc shaped member 36 to flex on the rigid pad 12 over the large central aperture 14. As best shown in FIGS. 1 and 2, the elastomer disc shaped member is secured to the rigid pad 12 by a plurality of fasteners placed through the elastomer disc shaped member 36 at its circumference and into the rigid pad 12 about the large central aperture 14. As best shown in FIG. 5, 6 and 7 the elastomer disc shaper member 36 is secured to the rigid pad 12 by a either a vulcanizing process or permanent adhesive 42 at its circumference and on the rigid pad 12 about the large central aperture 14.

To use the flexible sander 10 the user 34 should do the following steps:

1. Removably attach the spindle 18 to the chuck of the driving unit 22.
2. Turn on the driving unit 22, so that the sander 10 will rotate.
3. Place the abrasive sheet 28 against the work surface 32 with a slight pressure.
4. Move the sander 10 in a pendulum motion across the work surface 32.
5. The elastomer disc shaped member 36 will flex over the large central aperture 14 in the rigid pad 12 to always allow the abrasive sheet to remain in a flat contact with the work surface 32.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A disc sander implement which comprises:

a) a circular rigid pad fabricated out of a durable material having a rigid circumferential periphery extending around a circumferential periphery of the implement and having a large central aperture therethrough;

b) an elastometric disc shaped flexible connector having an annular concave recess formed at a central location in a top surface thereof, to permit the elastometric connector to flex on said rigid pad in said large central aperture and the elastometric connector being secured only at a circumferential periphery secured to said rigid pad in said large central aperture;

c) a spindle having an enlarged head embedded into the elastometric connector at a location concentric with the annular recess for detachably connecting said rigid pad to a driving unit and for rotation relative to a portion of the driving unit, so that said large central aperture in said rigid pad will give clearance for bending and flexing of said elastometric connector when rotating;

d) a cushion member of sponge rubber attached to said rigid pad by a permanent adhesive; and e) an abrasive sheet removably affixed to a front side of said cushion member by adhesive, said elastometric connector being the sole means of connecting the spindle to the rigid pad so that the flexure of the elastometric connector permits said abrasive sheet always to remain in a flat contact with a work surface with a slight pressure and little effort when a user of the driving unit moves said sander in a pendulum motion across the work surface.

2. A disc sander implement as recited in claim 1, wherein said elastomeric connector is secured to said rigid pad by a plurality of fasteners placed through said elastomer disc shaped connector at its circumference and into said rigid pad in said large central aperture.

3. A disc sander implement as recited in claim 1, wherein said elastomeric connector is secured to said rigid pad by a permanent adhesive at its circumference and on said rigid pad in said large central aperture.

4. A disc sander implement as recited in claim 1, wherein said elastomeric connector is secured to said rigid pad by a vulcanizing process at its circumference and on said rigid pad in said large central aperture.

5. A disc sander as recited in claim 1 in which the spindle head is disc-shaped.

* * * * *